United States Patent [19]

Barnes et al.

[11] 4,159,230

[45] Jun. 26, 1979

[54] TREATMENT OF CHROMIUM ELECTRODEPOSIT

[75] Inventors: Clive Barnes, West Hanney near Wantage; John J. B. Ward, Belmont Park, Wantage, both of England

[73] Assignee: International Lead Zinc Research Organization, Inc., New York, N.Y.

[21] Appl. No.: 882,442

[22] Filed: Mar. 1, 1978

[30] Foreign Application Priority Data

Apr. 3, 1977 [GB] United Kingdom ..... 9289/77

[51] Int. Cl.[2] ..... C25D 5/48

[52] U.S. Cl. ..... 204/35 N; 428/621; 428/658; 428/666

[58] Field of Search ..... 204/35 R; 428/658, 666, 428/621; 427/372 B

[56] References Cited

U.S. PATENT DOCUMENTS 2,796,361 6/1957 Chester ..... 428/658

3,323,881 6/1967 Nelson ..... 428/658

*Primary Examiner*—John H. Mack
*Assistant Examiner*—William Leader
*Attorney, Agent, or Firm*—Brumbaugh, Graves, Donohue & Raymond

[57] ABSTRACT

A method whereby a surface of chromium metal electrodeposited on a zinc substrate from a trivalent chromium electrolyte is treated by contacting the surface with an aqueous solution at a pH of from 5 to 12 and containing a dissolved metal salt of a weak acid which does not form a soluble complex with zinc. Preferred salts are carbonates, phosphates and silicates of an alkali metal, e.g. sodium or potassium. Also disclosed is the product of said process comprising an article having a zinc substrate, a microporous electrodeposited chromium coating from 0.025 to 2.5 microns in thickness on said substrate, and a water-insoluble basic salt of zinc within the micropores.

9 Claims, No Drawings

TREATMENT OF CHROMIUM ELECTRODEPOSIT

Chromium metal and alloy plated layers are widely used to provide corrosion protection on many types of metal surfaces. The classic chromium electroplating bath has consisted of a solution of chromic acid, but this has several disadvantages including toxicity, pollution problems, and the difficulty of plating directly onto certain metal substrates due to the corrosive nature of the bath. More recently, as described in British Pat. No. 1,144,913 and U.S. Pat. No. 3,917,517, there have become available plating baths based on trivalent chromium, which to some extent overcome the disadvantages noted of hexavalent chromium plating baths. Using trivalent chromium plating baths, it is possible, as described in British Pat. No. 1,388,693, to electroplate chromium directly onto zinc substrates. By "zinc substrates" it is meant not only articles composed of zinc, but also articles composed of some other metal, to which an outer layer of zinc has been applied. Our co-pending U.S. application Ser. No. 669,276 filed Mar. 22, 1976, now U.S. Pat. No. 4,064,743 describes a process for electrodepositing level coatings of zinc onto diecastings, which coatings can serve as the substrate for decorative chromium outer layers.

The corrosion resistance of chromium-plated zinc substrates is variable. It is an object of this invention to provide after-treatment whereby the corrosion resistance may be made more consistently high.

In one embodiment, the present invention provides a method of treating a substrate of, or having an outer layer of, zinc, which method comprises the steps of:

(a) immersing the zinc substrate in an aqueous electrolyte containing trivalent chromium ions and forming a chromium electrodeposit on the substrate, (b) contacting the coated substrate with an aqueous solution at a pH of from 5 to 12 containing a dissolved metal salt of a weak acid which does not form a soluble complex with zinc, and (c) rinsing and drying the treated coated substrate.

In another embodiment, the invention provides a metal object having:

(a) a substrate of, or having an outer layer of, zinc, (b) an adherent microporous or microcracked electrodeposit of chromium thereon, from 0.025 to 2.5 microns in thickness, (c) within the pores or cracks of the chromium electrodeposit, a water-insoluble basic salt of zinc, (d) said object having resistance to neutral 1% salt spray of at least 96 hours.

While the precise mechanism by which the surprising effects of the invention are obtained is not perfectly understood, the following explanation is offered. It is known that thin trivalent chromium electrodeposits are microporous, that is to say, they have a large number, on the order of $10^6$ per square centimeter, of pores having an average diameter of the order of 0.5 to 1 microns. In thicker chromium electrodeposits, having a thickness greater than about 0.25 microns, these separate pores are to some extent interconnected into microcracks having an average width of the order of 0.1 to 0.5 micron. Micropores and microcracks of this size are characteristic of chromium electrodeposited from a trivalent bath. Chromium electrodeposits generally cannot be formed by hexavalent chromium baths on zinc substrates because of the corrosion problem. To the extent that they are formed, they contain pores 10 to 30 times larger and 10 to 30 times fewer in number than those in microcracked trivalent chromium deposits. Such large pores could not, as a practical matter, be sealed by the method of this invention.

On exposure of a chromium-coated zinc substrate to a corrosive atmosphere, the atmosphere enters the pores or cracks and reacts with the exposed zinc to form powdery corrosion products. If these powdery corrosion products are allowed to dry they become insoluble in water and remain in the pores of the chromium coating, thus protecting the zinc from further corrosion. If the powdery deposits are never allowed to dry, they are leached out of the pores, and the zinc becomes open to further progressive attack. Consistent with this theory, in the past the corrosion resistance of chromium-plated zinc substrates would vary depending upon whether the atmospheric conditions were such that powdery zinc corrosion products would be initially formed and thereafter have been allowed to dry before the article is subjected to further corrosive environment. In theory, the present invention overcomes this problem by providing an after-treatment which forms and dries the powdery zinc corrosion products in the pores of the chromium coating.

The substrate may be of any metal which is not attacked by the trivalent chromium plating bath, for example a zinc diecasting, or steel, brass, copper, nickel, aluminum, magnesium or metallized plastics coated with zinc, suitably by the process of our U.S. Patent Application Ser. No. 669,276 filed Mar. 22, 1976. The chromium electrodeposit may be formed from any suitable trivalent chromium plating bath by methods which are not in themselves new, for example according to U.S. Patent Application Ser. No. 668,443 filed Mar. 19, 1976 and U.S. Pat. No. 3,917,517. The electrodeposit thickness should, as previously stated, be from 0.025 to 2.5 microns. Below 0.025 microns, the protection from corrosion may be inadequate. Coatings above 2.5 microns are expensive and do not provide significant added corrosion protection.

The plated substrate should be rinsed, and if the plate is thick the rinse should be in hot water to ensure microcrack development, and is then ready for the next stage. It is contacted with an aqueous solution containing a dissolved metal salt of a weak acid. Since the object of this step is to form a water-insoluble zinc salt in the pores of the chromium layer, it is necessary that the salt of the weak acid in the aqueous solution should not form a soluble complex with zinc under the conditions of treatment. Ammonium salts may be unsuitable at some pH values for this reason, as are salts of some organic acids such as citrate. Preferred salts are carbonates, phosphates of all kinds, and silicates. The metal ion is preferably an alkali metal, e.g. sodium or potassium. Particularly preferred salts are sodium bicarbonate, and sodium orthophosphate, buffered to the required pH with sodium, hydrogen or dihydrogen phosphate. The concentration of the aqueous solution is not critical, and from 5 grams per liter up to saturation has been found satisfactory.

The pH of the aqueous solution is from 5 to 12, preferably from 6 to 10 particularly from 6 to 8. Much below pH 6, most zinc salts are water-soluble. Above pH 10, there is risk of solubilizing zinc by zincate formation and above pH 12 this risk becomes paramount.

The coated substrate may be contacted with the aqueous solution by spraying, or more preferably by dipping, suitably for from 5 seconds to 1 hour, preferably 30 seconds to 5 minutes. The optimum dipping time will depend on the pH, concentration and termperature of the aqueous solution, and can readily be determined by one skilled in the art. The temperature of the aqueous solution is not critical, and may suitably be from 10° to 50° C., preferably from 25° to 35° C.

The coated dipped substrate is rinsed and then dried. The drying step is important, and is preferably effected in an oven at a temperature up to 60° C., which has the desirable effect of partly dehydrating the insoluble zinc salt. Alternatively, drying may be at ambient temperatures. Drying times are likely to be 1 hour or less at 60° C. up to 24 hours or more at ambient temperature.

An alternative way of improving the corrosion resistance of a chromium plated metal article would be to provide on it a chromate coating, that is to say a thin transparent coating of a mixed valence chromium compound by a dipping process. The process of the present invention is preferable, for it is cheaper and does not involve the use of toxic hazardous hexavalent chromium baths.

The following Example illustrates the invention.

Four cast iron objects were provided with a level electrodeposited coating of zinc by the process of U.S. Patent Application Ser. No. 669,276, and were then placed in a trivalent chromium electroplating bath and provided with an adherent microporous chromium deposit 0.25 microns thick. The four articles were then subjected to various after-treatments, as follows:

a. The plated article was rinsed and then subjected immediately to the neutral 1% salt spray test. Corrosion commenced at once, showing the corrosion resistance under the test was 0 hours.

b. The plated article was rinsed and dried in air for 24 hours, and then placed in the salt spray cabinet. The corrosion resistance was in the range 8 to 16 hours.

c. The plated article was rinsed and dried in an oven at 60° C. for 1 hour before being placed in the salt spray cabinet. The corrosion resistance was very variable (over a large number of repetitions of the experiment) but was always less than 96 hours.

d. The plated article was rinsed, dipped for two minutes in a 10% by weight solution of sodium bicarbonate, dried in an oven at 60° C. for 1 hour, and then placed in the salt spray cabinet. The corrosion resistance was greater than 96 hours.

We claim:

1. A method of treating an article having an outer surface of zinc comprising the steps of (a) from an electrolyte containing trivalent chromium ions electrodepositing chromium on said zinc outer surface so as to obtain a microporous or microcracked chromium layer, (b) thereafter contacting the outer surface with an aqueous solution; said solution being at a pH of from 5 to 12 and containing a dissolved metal salt of a weak acid, said dissolved metal salt being selected so as to not form a water soluble complex of zinc, and (c) rinsing and drying the treated outer surface.

2. A method as described in claim 1 wherein the metal salt is at least one of the group consisting of metal carbonates, phosphates and silicates.

3. A method as described in claim 2 wherein the metal salt is an alkali metal salt.

4. A method as described in claim 3 wherein the alkali metal is at least one of the group consisting of sodium or potassium.

5. A method as described in claim 4 wherein the treated outer surface is dried at a temperature up to 60° C. until substantially all water is removed from said surface.

6. A method as described in claim 2 wherein the pH of said aqueous solution is in the range from 6 to 10.

7. A method as described in claim 6 wherein the pH of said aqueous solution is in the range from 6 to 8.

8. An article treated according to the method of claim 1 and having a zinc outer surface with a chromium layer electrodeposited thereon, said chromium layer being microporous or microcracked and from 0.025 to 2.5 microns in thickness, said micropores or microcracks having thereon a water-insoluble basic salt of zinc.

9. A treated article according to claim 8 wherein said basic salt of zinc is at least one of the group consisting of zinc carbonate, zinc phosphate and zinc silicate.

* * * * *

UNITED STATES PATENT AND TRADEMARK OFFICE

CERTIFICATE OF CORRECTION

PATENT NO. : 4,159,230

DATED : June 26, 1979

INVENTOR(S) : Clive Barnes and John J. B. Ward

It is certified that error appears in the above-identified patent and that said Letters Patent are hereby corrected as shown below:

First page, Item [30], "Apr. 3, 1977" should be --Mar. 4, 1977--. Column 1, line 23, "4,064,743" should be --4,048,024--; line 50, "1%" should be --1-0/0--. Column 3, line 31, "1%" should be --1-0/0--.

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*